US006135925A

United States Patent [19]

Liu

[11] Patent Number: 6,135,925

[45] Date of Patent: Oct. 24, 2000

[54] RUNNING EXERCISER

[76] Inventor: Chien Hsing Liu, No. 71, Fu-Hsing Street, Tai-Ping City, Taichung Hsien, Taiwan

[21] Appl. No.: 09/370,875

[22] Filed: Aug. 10, 1999

[51] Int. Cl.[7] ..... A63B 22/00

[52] U.S. Cl. ..... 482/54; 482/51

[58] Field of Search ..... 482/51, 54

[56] References Cited

U.S. PATENT DOCUMENTS 5,676,624 10/1997 Watterson et al. ..... 482/54

5,855,537 1/1999 Coody et al. ..... 482/54

*Primary Examiner*—Glenn E. Richman

*Attorney, Agent, or Firm*—Rosenberg, Klein & Lee

[57] ABSTRACT

A running exerciser includes a vertical column, a base seat and a longitudinal transmission mechanism. The inclination of the base seat can be adjusted from downward slope to upward slope and folded. Therefore, the range of adjustment of inclination is widened. The running exerciser driven by the transmission mechanism has high stability and the folding and inclination adjustment of the running exerciser can be accomplished by only one power source. The structure of the running exerciser is simple and the cost is low. Also, the safety in use of the running exerciser can be ensured.

8 Claims, 10 Drawing Sheets

RUNNING EXERCISER

BACKGROUND OF THE INVENTION

The present invention relates to a running exerciser in which the range of adjustment of inclination of the base seat is wider. The running exerciser has simple structure and can be more safely folded and stored.

FIG. 8 shows an existing running exerciser in which the front end of the base seat 9 is pivotally disposed on a support frame 91. A control panel 92 and a handle 93 are mounted on the support frame 91. A motor 94 is disposed at the front end of the support frame 91. The motor 94 drives an adjustment spiral rod 95 connected with the front end of the base seat 9 so as to lift or lower the front end of the base seat 9 and change the inclination thereof. A user can adjust the inclination according to the required exercising extent.

FIG. 9 shows another type of existing running exerciser in which the rear end of the base seat 9A is disposed with a motor 94A, an adjustment spiral rod 95A and a linking lever 97. The motor 94A makes the spiral rod 95A drive the linking lever 97 so as to lift or lower the base seat A and adjust the inclination thereof. When stored, the base seat 9A and the support frame 91A are folded toward each other at the pivot section 96A to reduce the volume as shown in FIG. 10.

Although the above two conventional running exercisers can be adjusted in inclination, the range of adjustment of inclination is only within about zero to 12%, that is, the adjustable height is 12% of the length of the base seat 9, 9A due to limitation of the length of the spiral rod 95, 95A. In the case that the spiral rod 95, 95A are elongated to increase the adjustment range, the cost will be relatively high and the stability of the running exerciser will be affected. Especially, a user must exercise on the base seat 9, 9A so that it is very important for the running exerciser to have sufficient stability and safety. Accordingly, the existing running exercisers can be adjusted by only about 12% inclination. This cannot apparently change the exercising extent and can only achieve a poor using effect.

Furthermore, in order to save strength and facilitate the folding operation, the existing running exerciser is often equipped with an additional power source (not shown) on one side of the support frame 91A for folding the running exerciser. As a result, the running exerciser will be equipped with a power source 98 for driving the running belt, a power source for adjusting the inclination and an additional power source for folding the running exerciser. This leads to high cost of the running exerciser. Also, the base seat 9A and the support frame 91A have considerable length so that the power source for folding operation must have sufficient torque for folding the running exerciser. Due to the great torque of the power source and the pivotal connection between the base seat 9A and the support frame 91A, a user may be clamped by the base seat 9A and the support frame 91A and get injured or be hit by the rear end 99 which is quickly upward turned. This will cause danger in use of the running exerciser.

SUMMARY OF THE INVENTION

It is therefore a primary object of the present invention to provide a running exerciser including a longitudinal transmission by which the inclination of the base seat of the running exerciser can be adjusted from downward slope to upward slope and folded. Therefore, the range of adjustment of inclination is widened. The running exerciser driven by the transmission mechanism has high stability and the folding and inclination adjustment of the running exerciser can be accomplished by only one power source. The structure of the running exerciser is simple and the cost is low.

It is a further object of the present invention to provide the above running exerciser which can be folded and stored without possibility of clamping and injuring a user so as to ensure safety in use.

The present invention can be best understood through the following description and accompanying drawings wherein:

DETAILED DESCRIPTION OF THE PREFERRED EMBODIMENTS

Figure 1:
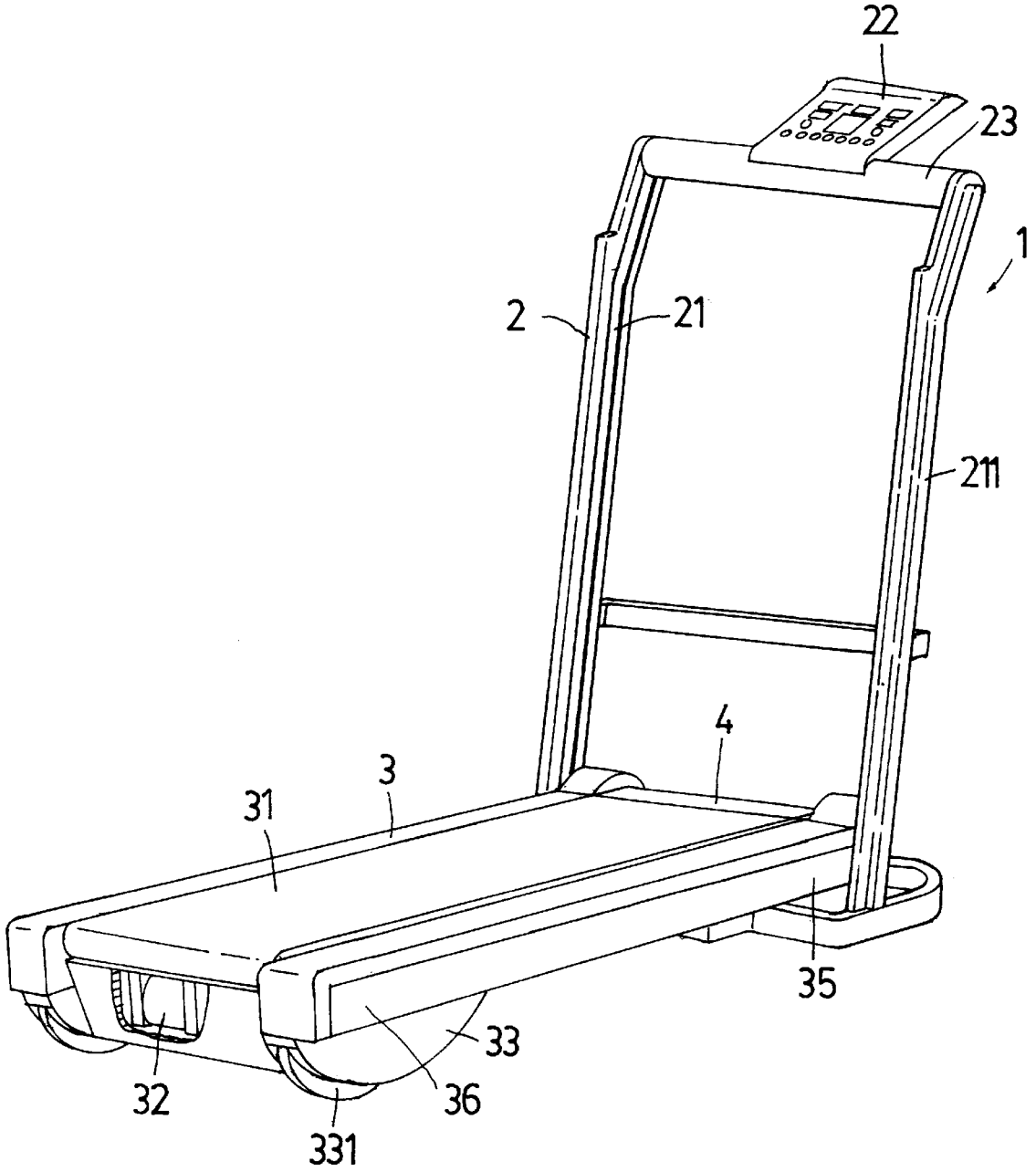
FIG. 1 is a perspective view of the running exerciser of the present invention.

Please refer to FIGS. 1 to 7. The present invention includes:

- a support frame 1 made of a T-shaped steel material by bending, the support frame 1 having two vertical columns 2 on two sides, an inner side of each column 2 being formed with a longitudinal receptacle 21, an outer side of the receptacle 21 being disposed with a guide rail 211, a control panel 22 and a handle 23 being mounted on the columns 2, a guide member 24 being disposed in the receptacle 21 and upward extending to top end of the receptacle 21, the guide member 24 being a chain in this embodiment;
- a base seat 3 on which an endless running belt 31 is mounted, one side of the base seat 3 being disposed with a first power source 32 for driving the running belt 31, a rear end 36 of the base seat 3 being disposed with a substantially arch retaining section 33, a wheel 331 being mounted under a bottom end of the retaining sect ion 33 for facilitating transferring; and
- a longitudinal transmission mechanism 4 disposed on front side of the base seat 3, the transmission mechanism 4 having a second power source 34 connected with multiple driving units 41. In this embodiment, each driving unit 41 includes a shaft 411 and a sprocket 412 and a guide wheel 413 respectively mounted on two sides of the shaft 411. The sprocket 412 is engaged with the guide member 24. The guide wheel 413 is disposed in the guide rail 211. The driving unit 41 is guided by the guide member 24 to make the front end 35 of the base seat 3 move up and down. The driving unit 41 is engaged with the guide member 24. One of the driving units 41 is driven by the second power source 34, while the remaining driving units 41 make the transmission mechanism 4 firmly connected with the support frame 1.

Figure 4:
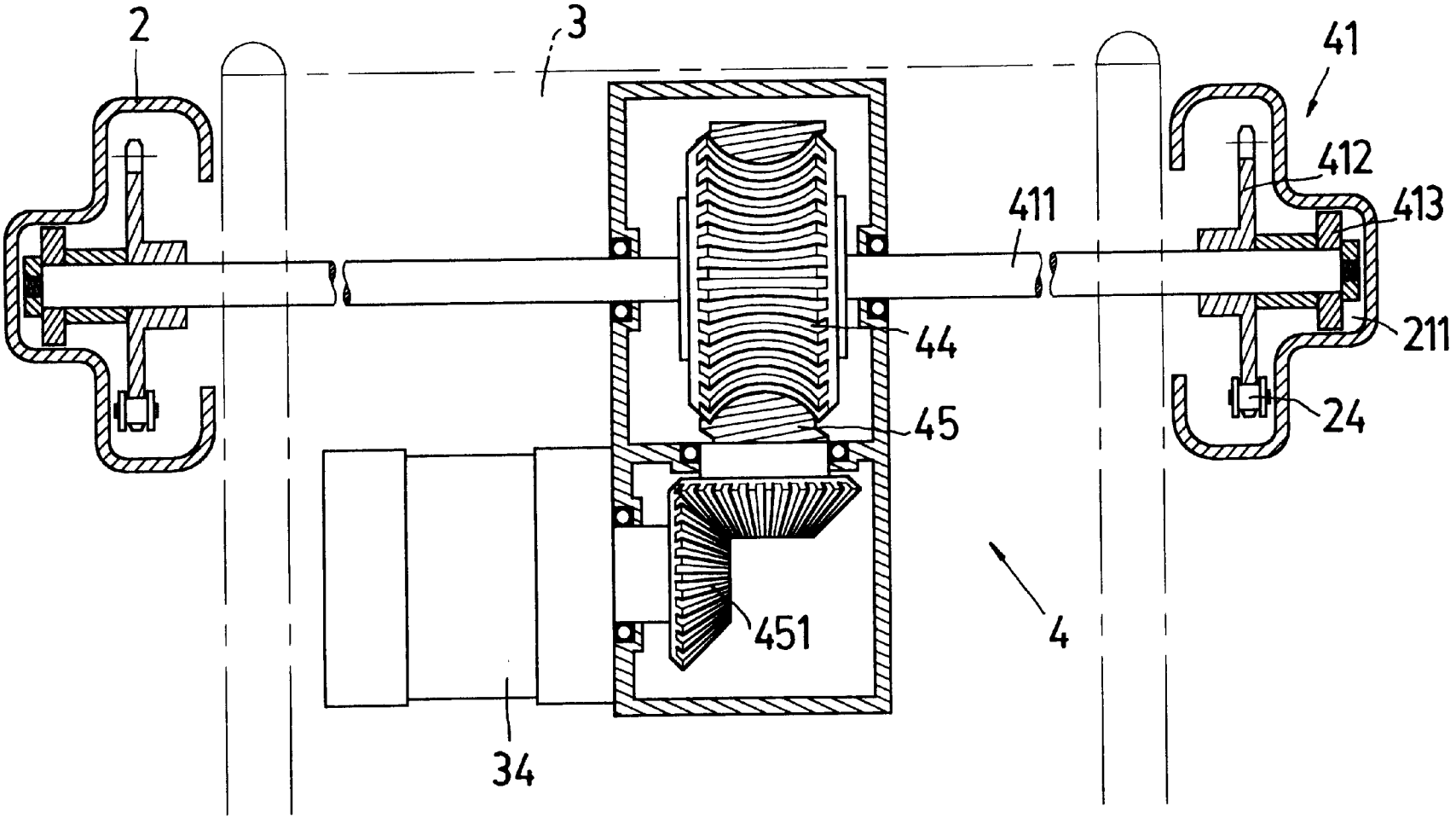
FIG. 4 is a sectional view showing the transmission mechanism of the present invention.

In addition, as shown in FIG. 4, the shaft 411 of the driving unit 41 driven by the second power source 34 is disposed with a spiral wheel 44 at middle portion. The second power source 34 is disposed with a gear set 451 and a spiral rod 45 meshing with the spiral wheel 44. The second power source 34 drives the shaft 411 to rotate. At this time, the sprocket 412 on two sides of the shaft 411 are driven to make the driving unit 41 rotate and climb on the guide member 24 of the column 2. Under such circumstance, the front end 35 of the base seat 3 is driven to change the inclination of the base seat 3.

In the transmission mechanism 4, the spiral rod 45 meshes with the spiral wheel 44 of the shaft 411 to achieve a self-locking effect against the reverse transmission, whereby after the inclination of the base seat 3 is changed, the inclination can be maintained, that is, the base seat 3 will not slip down and can be stably located. A user can step thereon without worrying about sudden change of the inclination of the base seat 3 due to the user's weight.

Figure 2:
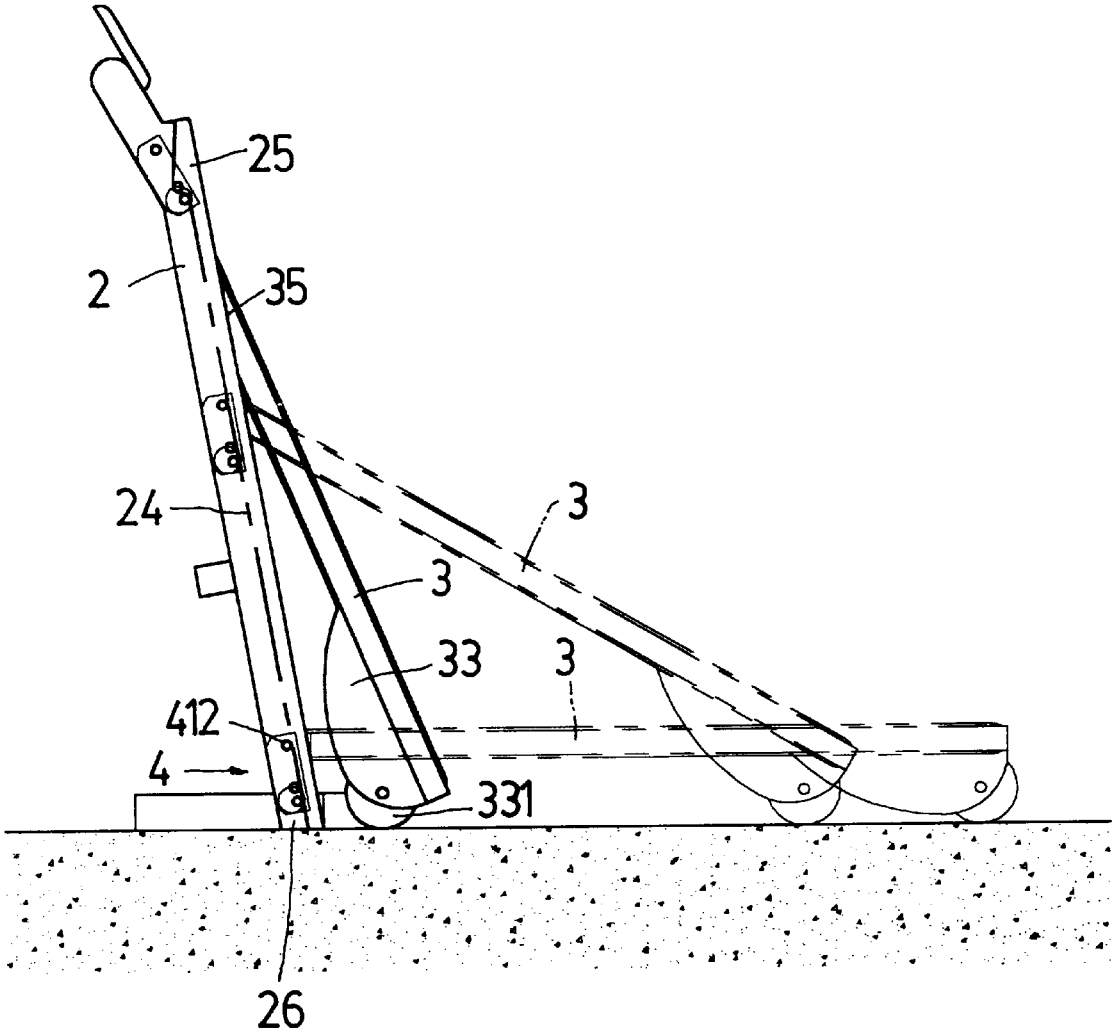
FIG. 2 is a side view showing the adjustment of the inclination and folding operation of the present invention.
Figure 3:
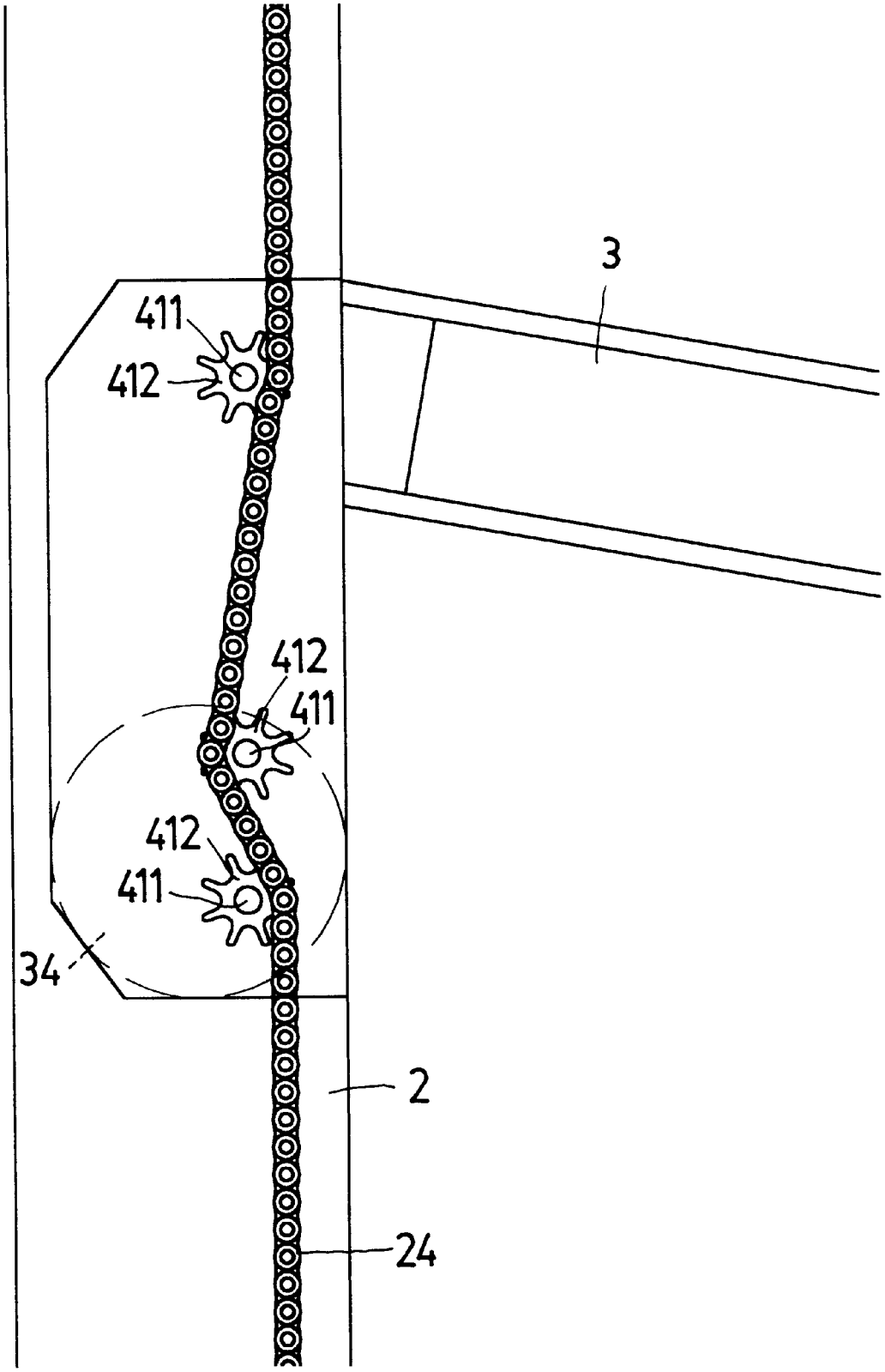
FIG. 3 is a plane view of the chain and sprocket of the present invention.
Figure 6:
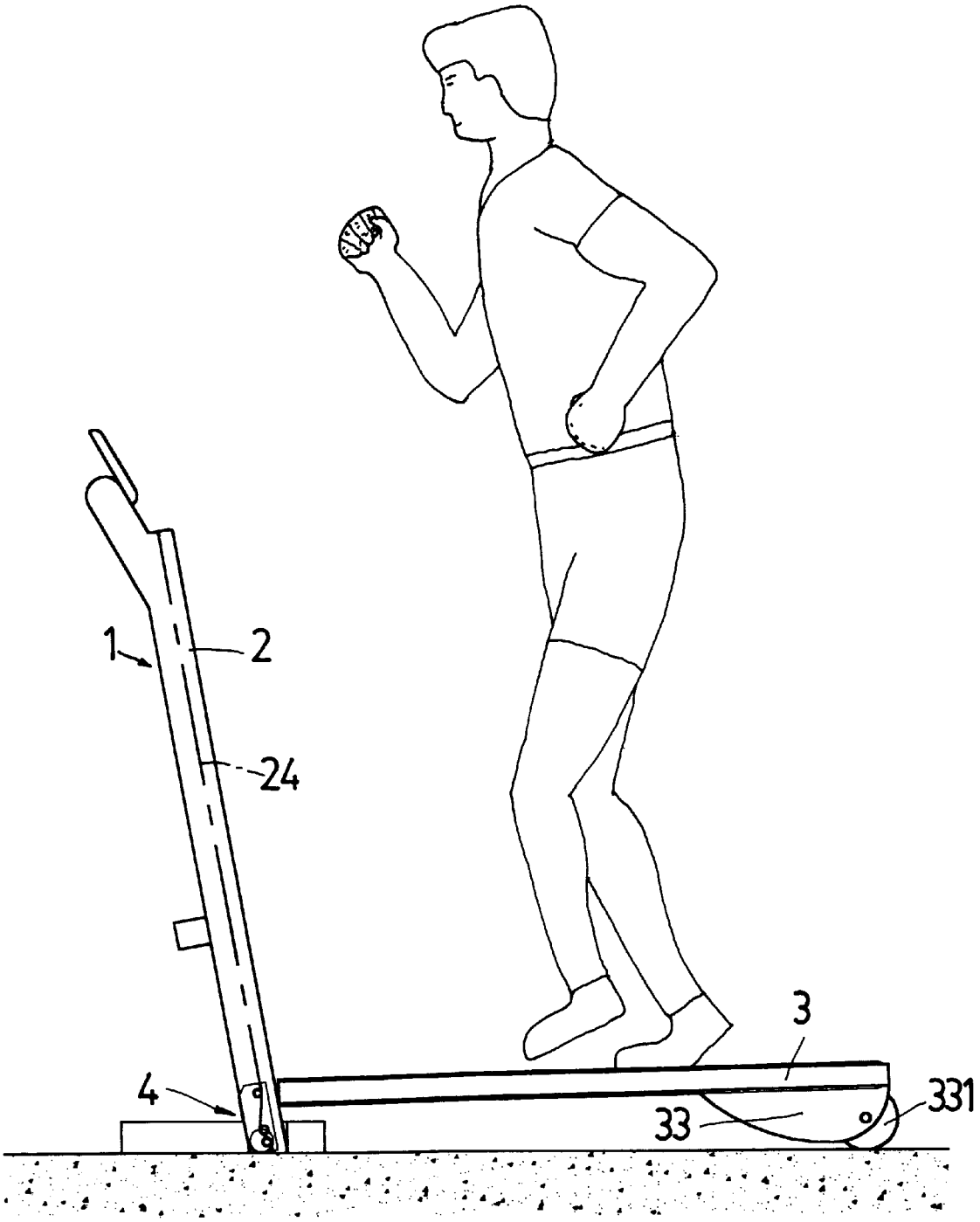
FIG. 6 shows the use of the present invention.
Figure 7:
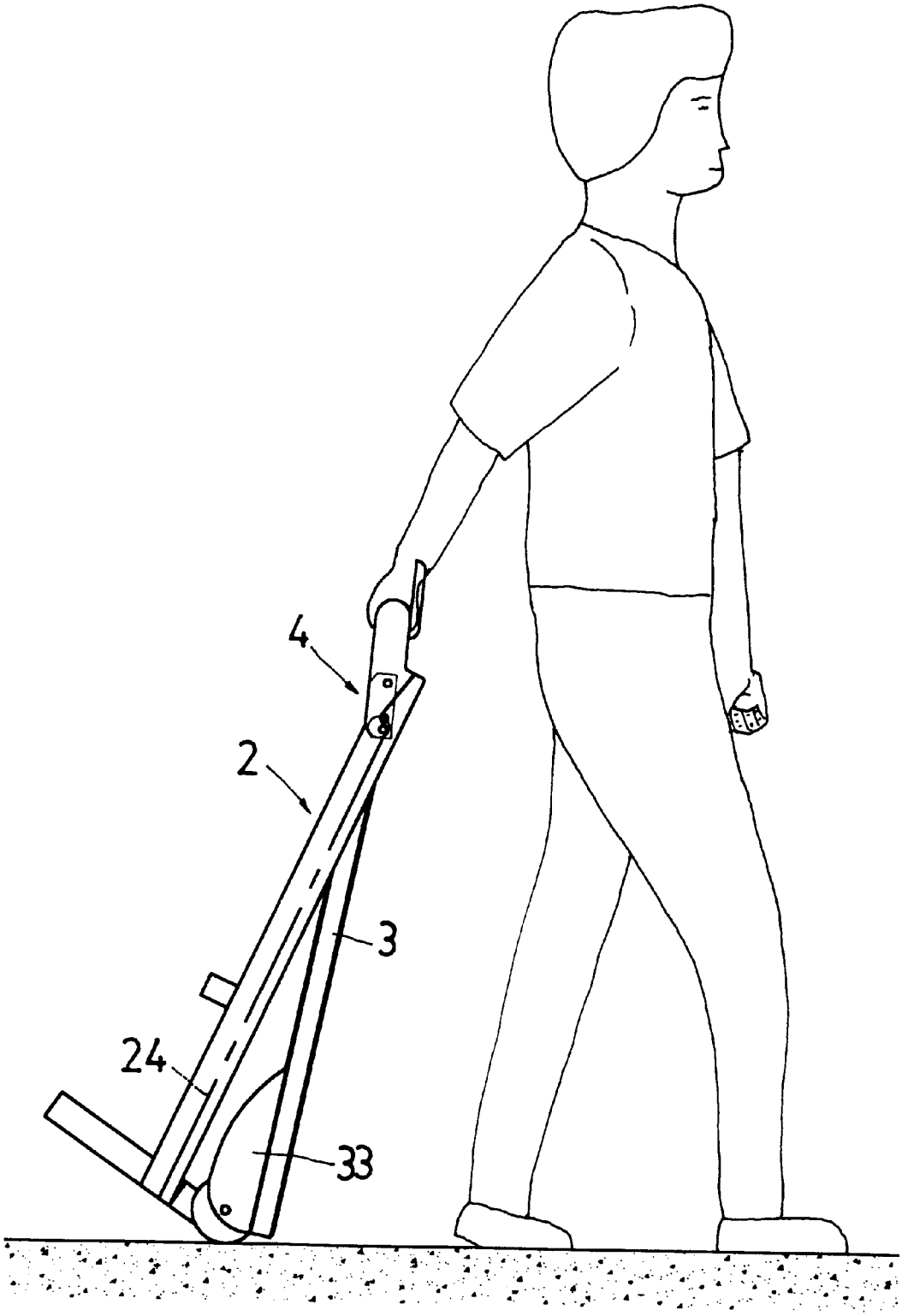
FIG. 7 shows that the present invention is easily transferred by a user.
Figure 8:
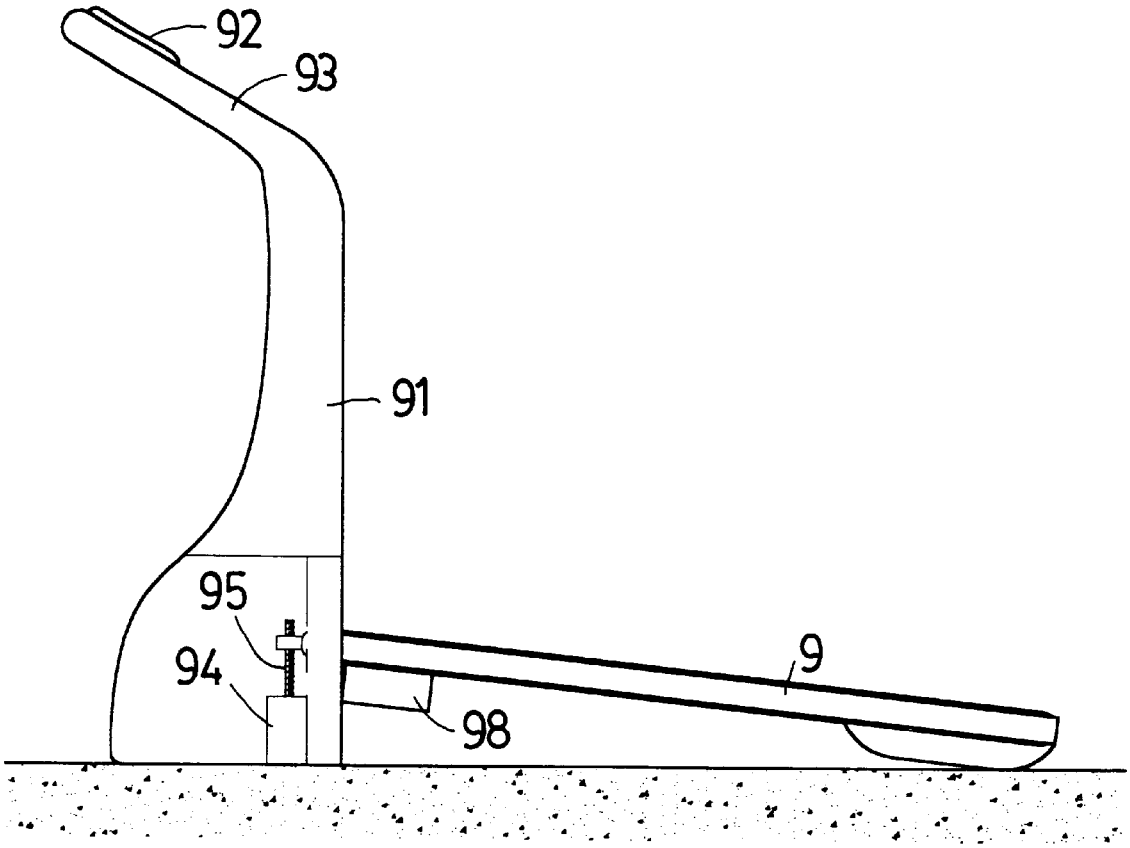
PRIOR ART FIG. 8
FIG. 8 is a side view of a first type of conventional running exerciser.
Figure 9:
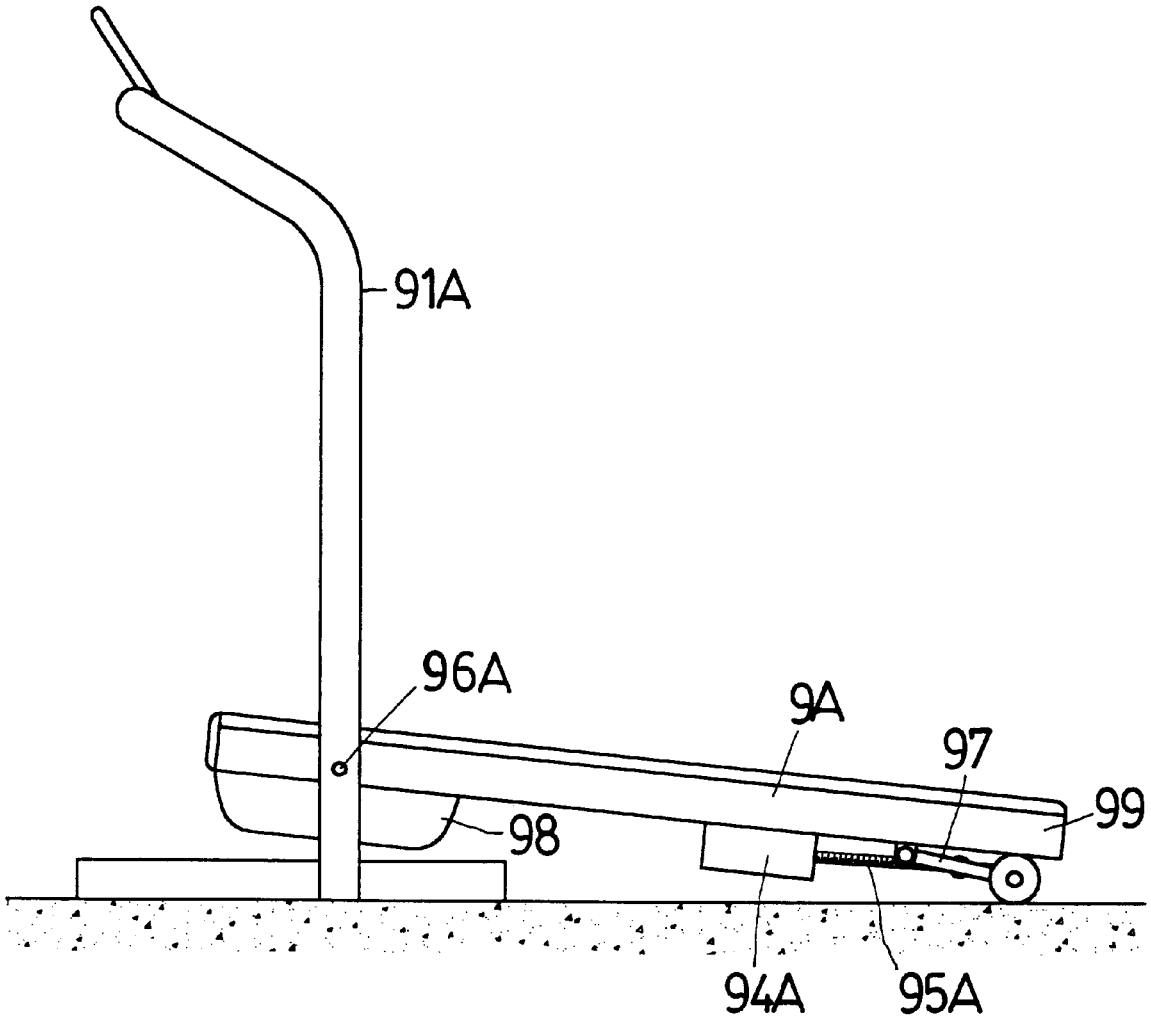
PRIOR ART FIG. 9
FIG. 9 is a side view of a second type of conventional running exerciser.
Figure 10:
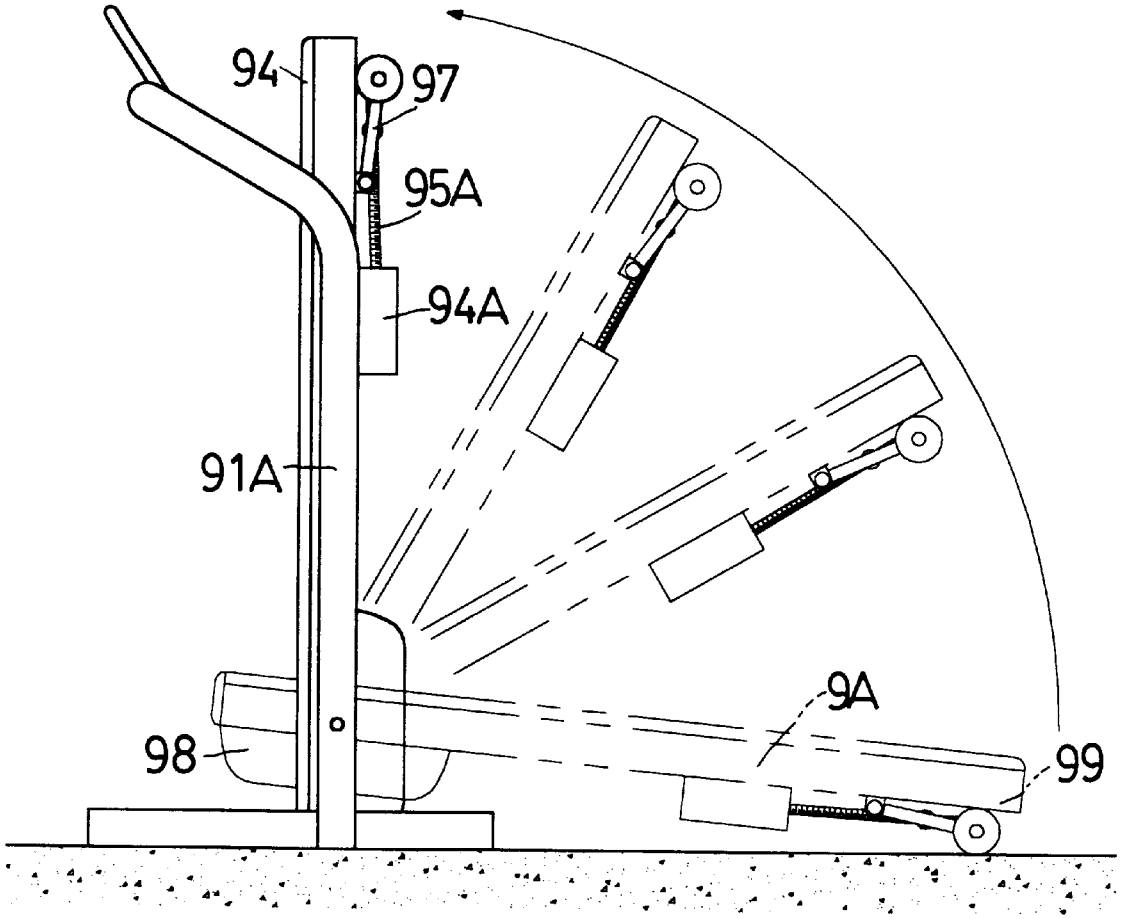
PRIOR ART FIG. 10
FIG. 10 shows the folding operation of the second type of conventional running exerciser.

When folding the present invention, the second power source 34 is activated to make the driving unit 41 climb to a position near the top section 25 of the column 2. As shown in FIG. 2, the front end 35 of the base seat 3 and the top section 25 of the column 2 are stored, while the rear end 36 of the base seat 3 and the bottom section 26 of the column 2 are moved so as to fold the running exerciser. The running exerciser is folded by means of the transmission mechanism 4 so that the second power source 34 only needs to bear the climbing of one end of the base seat 3. The other end of the base seat 3 is supported on the ground so that no great torque is required. Moreover, the base seat 3 and the columns 2 are not stored by means of folding toward each other so that the user will not be clamped and the safety in using the running exerciser is ensured. As shown in FIG. 6, the inclination of the present invention can be adjusted to minus 2%, that is, the base seat 3 can be adjusted to have a downward inclination. As shown in FIG. 7, after folded, the wheels 331 of the retaining section 33 contact with the ground to facilitate transferring of the running exerciser.

Figure 5:
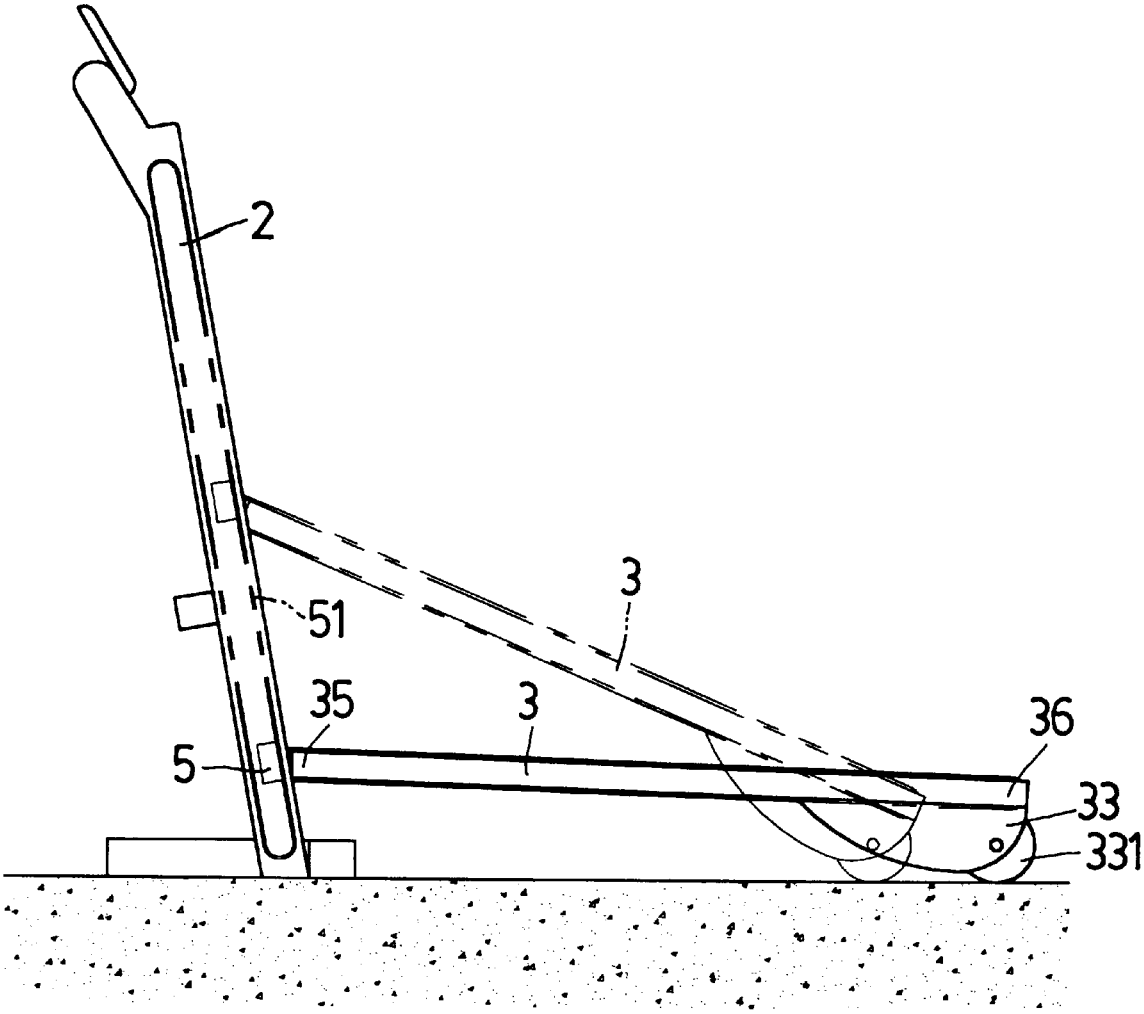
FIG. 5 is a side view showing the operation of a second embodiment of the present invention.

FIG. 5 shows a second embodiment of the present invention, in which the front end of the base seat 3 is fixed on a fixing member 5 which is fixed on a belt 51. By means of rotating the belt 51, the height of the fixing member 5 can be changed so as to drive the base seat 3 for adjusting the inclination thereof and storing the base seat 3.

The inclination of the base seat 3 can be adjusted from downward slope to upward slope and folded. The inclination can be adjusted beyond the limitation of 12%. Therefore, the range of adjustment of inclination is widened. Especially, for an oldster, the base seat 3 can be adjusted to have about 40% inclination for slow speed exercise so as to achieve a greater exercising extent. In addition, the adjustment of inclination does not necessitate a power source with very high torque. The running exerciser driven by the transmission mechanism 4 has high stability and the folding and inclination adjustment of the running exerciser can be accomplished by only one power source. The structure of the running exerciser is simple and the cost is low. In addition, the base seat 3 and the columns 2 are stored without the possibility of clamping and hurting a user so that the safety in use of the running exerciser can be ensured.

The above embodiments are only used to illustrate the present invention, not intended to limit the scope thereof. Many modifications of the above embodiments can be made without departing from the spirit of the present invention.

What is claimed is:

1. A running exerciser comprising:

a support frame disposed on a base surface and having at least one substantially vertical column and a guide member disposed in the column and extending upward to a top end thereof;

a base seat having a front end and a rear end and on which an endless running belt is mounted, one side of the base seat being disposed with a first power source for driving the running belt; and a longitudinal transmission mechanism disposed on a front side of the base seat, the transmission mechanism having a second power source connected with at least one driving unit, the driving unit being guided by the guide member to make the front end of the base seat move up and down, wherein during upward movement of the front end of the base seat, the rear end of the base seat moves forward and continuously contacts the base surface and the front end of the base seat moves toward a top portion of said vertical column, at the top portion the base seat reaches a folded position, and wherein during downward movement of the front end of the base seat, the rear end of the base seat moves backward and continuously contacts the base surface and the front end of the base seat moves toward a bottom portion of said vertical column.

2. A running exerciser as claimed in claim 1, wherein the column is made of a steel material having a T-shaped cross-sectional contour.

3. A running exerciser as claimed in claim 1, wherein a rear end of the base seat is disposed with a substantially arch retaining section, the wheel being mounted on a bottom end of the retaining section.

4. A running exerciser as claimed in claim 1, wherein the guide member is a chain and the driving unit includes a shaft and a sprocket and a guide wheel respectively mounted on two sides of the shaft, the sprocket being engaged with the guide member, an inner side of the column being formed with a longitudinal receptacle, a guide rail being disposed on outer side of the receptacle, the guide wheel being disposed in the guide rail.

5. A running exerciser as claimed in claim 4, wherein a spiral wheel is disposed at a middle portion of the shaft of the driving unit and the second power source is disposed with a spiral rod meshing with the spiral wheel.

6. A running exerciser as claimed in claim 1, wherein the transmission mechanism further includes multiple driving units for firmly connecting the transmission mechanism with the support frame.

7. A running exerciser as claimed in claim 1, wherein the driving unit is a fixing member fixed on the front end of the base seat, the fixing member being fixed on the guide member which is a belt disposed in the receptacle, whereby by means of rotating the belt, the height of the fixing member can be changed.

8. A running exerciser as claimed in claim 1, wherein a control panel and a handle are disposed on the column.

* * * * *